US005832828A

United States Patent [19]

Marmin et al.

[11] Patent Number: 5,832,828

[45] Date of Patent: Nov. 10, 1998

[54] INKING UNIT FOR A ROTARY PRINTING PRESS

[75] Inventors: Jean-Claude Marmin, Estress-Saint-Denis; Christian Beyne, Montmagny, both of France

[73] Assignees: Heidelberger Druckmaschinen AG, Heidelberg, Germany; Heidlberg Harris S.A., Montataire Cedex, France

[21] Appl. No.: 816,362

[22] Filed: Mar. 13, 1997

Related U.S. Application Data

[63] Continuation of Ser. No. 551,172, Oct. 31, 1995, abandoned.

[30] Foreign Application Priority Data

Oct. 31, 1994 [FR] France ..... 94 13036

[51] Int. Cl.[6] ..... B41F 31/06

[52] U.S. Cl. ..... 101/350.1; 101/365

[58] Field of Search ..... 101/207–210, 101/350, 363, 364, 365, 366, 350.2, 350.1, 148; 401/208, 219; 118/259

[56] References Cited

U.S. PATENT DOCUMENTS 512,562 1/1894 Moore ..... 101/363 X
3,263,264 8/1966 Leland ..... 401/219
3,356,442 12/1967 Leland ..... 101/363 X
4,357,871 11/1982 Köbler et al. .
5,327,830 7/1994 Gelinas et al. ..... 101/363

FOREIGN PATENT DOCUMENTS 0022912 1/1981 European Pat. Off. .
0508031 10/1992 European Pat. Off. .

*Primary Examiner*—J. Reed Fisher
*Attorney, Agent, or Firm*—Herbert L. Lerner; Laurence A. Greenberg

[57] ABSTRACT

An inking unit in a rotary printing press includes an ink fountain with a ductor blade, a ductor roller disposed adjacent the ink fountain, and one or more ink fountain pans removably disposed in the ink fountain. The ink fountain pan is formed with a duct through which printing ink is conveyed to the ductor roller. The duct is selectively closed and opened with a closure device, which includes a closure member pivotally mounted on the ink fountain pan. The closure member thereby pivots between a first pivot position in which the duct is open and a second pivot position in which the duct is closed.

7 Claims, 4 Drawing Sheets

30
31
14
6
22'
22'
7
32
30
32
4
1
8
17
5
25
22
14
17
29
26
4
16
12
16
3
2

INKING UNIT FOR A ROTARY PRINTING PRESS

This application is a continuation of application Ser. No. 08/551,172, filed on Oct. 31, 1995, now abandoned.

BACKGROUND OF THE INVENTION

1. Field of the Invention

The invention relates to an inking unit for a rotary printing press which includes an ink fountain carrying a ductor blade; at least one ink fountain pan is removably disposed in the ink fountain; the removable ink fountain pan is formed with a duct for conveying the printing ink to a ductor roller or the like.

2. Description of the Related Art

Inking units with ink fountain pans are conventionally known in the printing art. Several removable ink fountain pans often mounted side by side in the ink fountain so as to allow easy changes of color across the width of the rotary press. The printing art has known inking units in which the ductor blades applying the printing ink are situated either above or below a ductor roller. The art has also heretofore known types of construction in which the ductor blades are associated with the ink fountain pans or in which the blades are associated with (fixed) ink fountains.

The subject matter of the invention relates particularly to a genus in which the ink fountain carries at least one blade which is situated below the ductor roller.

European patent publication EP 0 508 031 discloses an ink fountain of the abovementioned type which includes a removable ink fountain pan. The front wall of the pan, which is associated with the ductor roller, is mounted slidably. After the removable ink fountain pan has been fastened in the ink fountain, the sliding wall is moved upwards and a duct is formed through which the printing ink can reach the ductor roller. When the removable ink fountain pan is taken out of the rotary printing press, the sliding wall is closed beforehand. In this way it is possible to change the ink rapidly without it being necessary to clean the machine because of ink leaks, or to empty the ink fountain pan of printing ink beforehand.

SUMMARY OF THE INVENTION

It is accordingly an object of the invention to provide an inking unit for a rotary printing press, which is improved as compared to the prior art and is of simple and stable construction which exhibits reliable operation and provides hermetic sealing.

With the foregoing and other objects in view there is provided, in accordance with the invention, an inking unit of a rotary printing press, comprising:

- an ink fountain carrying a ductor blade, a ductor roller disposed adjacent the ink fountain, and at least one ink fountain pan removably disposed in the ink fountain;
- the ink fountain pan having a duct formed therein for conveying printing ink to the ductor roller; and
- a closure device operatively associated with the duct, the closure device including a closure member pivotally mounted on the ink fountain pan between a first pivot position in which the duct is open and a second pivot position in which the duct is closed.

In other words, the object of the invention is attained in that the closure device includes a closure member mounted so that it can pivot on the removable ink fountain pan, which member opens the duct in a first pivoting position and closes the duct in a second pivoting position. By virtue of this configuration it is possible to render the ink fountain pan removable in a mechanically simple and stable fashion. The separate closure member provides for reliable opening and closing of the duct, for selectively conducting the printing ink to the ductor roller or the like. Due to the fact that the closure member is pivotally mounted on the ink fountain pan it is guided reliably and the pan is closed tightly.

If the closure member is pivoted into its first pivot position, the duct is opened. If the closure member is pivoted into its second pivot position, the duct is closed. The fact that the closure member is accurately mounted results in a tight fit, and it guarantees reliable opening and closing. Accordingly, when the removable ink fountain pan is removed from the fountain, there is no undesirable ink leakage, and it is therefore not necessary to empty the ink fountain pan of printing ink.

In a preferred embodiment of the invention, the set position of the ductor blade is guaranteed, even in the event that the removable ink fountain pan is removed for exchange. This is assured by the fact that the ductor blades are fixed to the ink fountain.

In accordance with an added feature of the invention, the closure member includes mutually coaxial cylinder portions pivotally disposed in the bearing bore.

In accordance with an additional feature of the invention, the bore is defined between two arched domes in the form of partial cylindrical surfaces facing one another and extending symmetrically relative to the cylinder axis, the duct being formed between the arched domes.

In accordance with another feature of the invention, the duct is bounded by walls, and the bearing bore is formed in the walls of the duct.

In accordance with a further feature of the invention, the closure member is formed with two mutually coaxial cylinder portions, and transverse members disposed between the cylinder portions, the transverse members being in the form of portions of a disc for closing the duct.

In other words, there are provided axially symmetric cylinder portions which are pivotally mounted in the bore against which the removable ink fountain pan bears. The cylinder portions of the closure member are guided accurately in the bearing bore of the ink fountain and they allow the closure member to be guided accurately, so that this member closes the duct tightly, yet can be pivoted between the first and second pivot positions with a minimum amount of effort. It is particularly advantageous for the bearing bore to be formed by hollows in the form of portions of axially symmetric cylindrical surfaces facing one another at least in places in order to form the duct. The bearing bore is thus formed—at least in part—in the walls of the duct.

The cylinder portions of the closure member thus serve to support its pivoting. The intermediate secant pieces for closing the duct which, in the first pivot position extend transversely across the duct and seal the same and, in the second pivot position, they merge into the side walls of the duct and thus open the duct. Owing to their sectional shape of axial sections of a disc, the transverse members seal, with their convex enveloping wall portion, against the wall portions of the bearing bore, which makes it possible to obtain optimum sealing.

In accordance with again an added feature of the invention, the closure member includes at least one actuating lever for pivoting the closure member, the actuating lever extending radially away from a pivot axis of the closure member. The actuating lever is preferably one of two actuating levers disposed at mutually opposite ends of the closure member, and the two levers are connected by a handle, such as a knob. The closure member is preferably pivoted between the first and second pivot positions by moving the actuating handle. This allows uniform pivoting of both levers between the first and second positions.

In accordance with a concomitant feature of the invention, there are provided several ink fountain pans which are individually removable and which are disposed side by side in the ink fountain.

Other features which are considered as characteristic for the invention are set forth in the appended claims.

Although the invention is illustrated and described herein as embodied in an inking unit for a rotary printing press, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
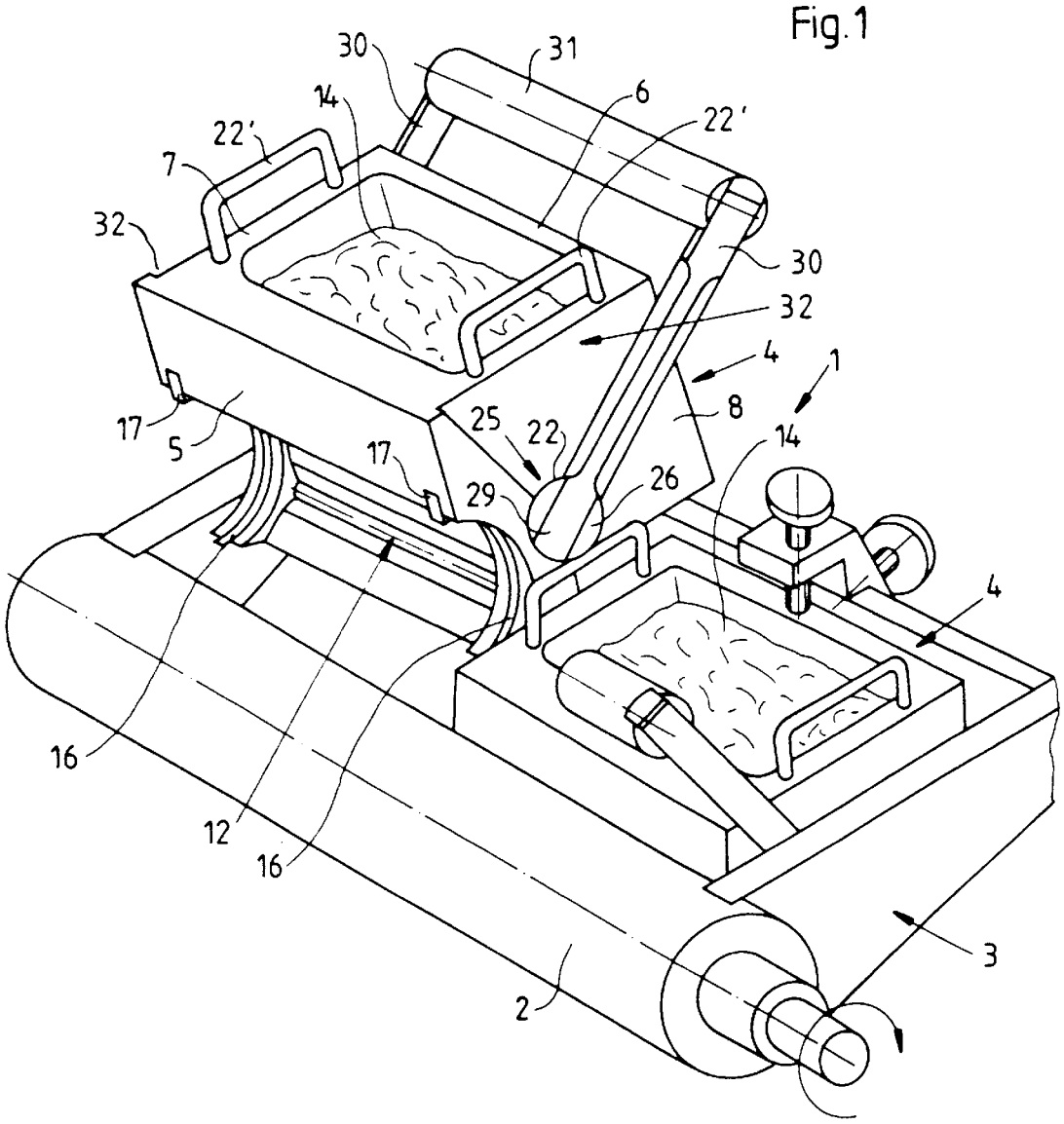
FIG. 1 is a perspective view of an inking unit of a rotary printing press.

Referring now to the figures of the drawing in detail and first, particularly, to FIG. 1 thereof, there is seen an inking unit 1 which forms part of a rotary printing press. The latter is not illustrated herein. The rotary printing press may be a web-fed or sheet-fed rotary printing press. It includes a ductor roller 2 or a fountain roller 2, from which the printing unit proper receives a thin film of ink, i.e. which transfers the ink to the ink-conveying elements of the rotary printing press.

The inking unit includes an ink fountain 3 into which in fountain pans 4 may be inserted. The ink fountain pans 4 are positioned side by side along the length of the ductor roller 2. According to the exemplary embodiment represented in FIG. 1, two ink fountain pans 4 may be associated with the ductor roller 2. However, according to other alternative embodiments, a greater number of ink fountain pans for the ductor roller may be provided.

Figure 4:
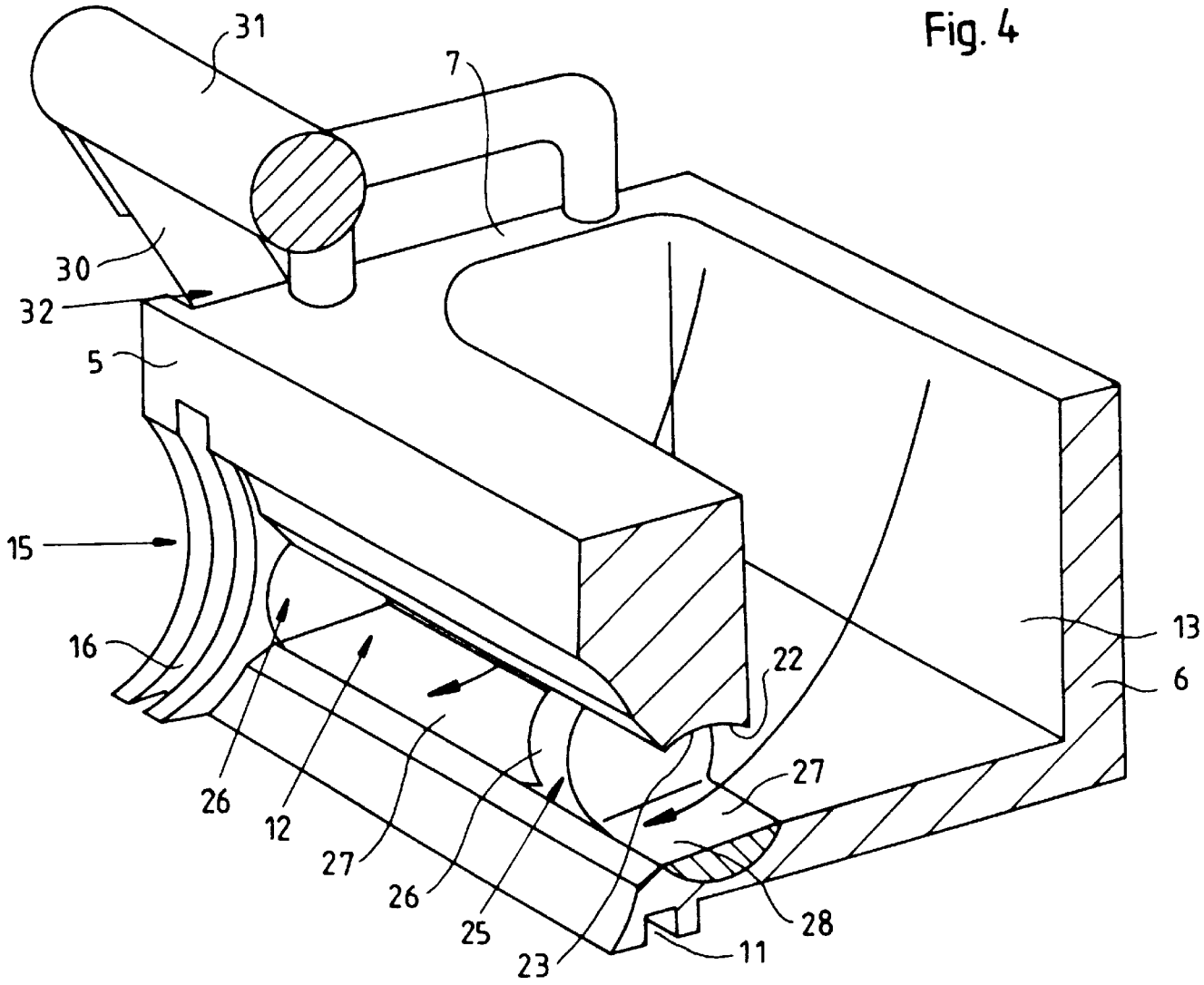
FIG. 4 is a partially cut-away, perspective view of the removable ink fountain pan.

Each ink fountain pan 4 includes a front wall 5, a rear wall 6, two mutually opposite side walls 7 and 8, and a bottom 9. On the bottom 9 there are provided a projecting part 10 (FIG. 2) and a groove 11 (FIG. 4). These alignment members allow proper positioning of the ink fountain pan 4 relative to the ink fountain 3. Corresponding alignment members are provided in the ink fountain 3 which interact with the projecting part 10 and the groove 11, respectively.

The front wall 5, which extends from the sidewall 7 to the sidewall 8, is formed with a duct 12. The duct 12 opens to the inside 13 of the ink fountain pan 4. Printing ink 14 thereby travels from inside the pan 13 through the duct 12 and to the ductor roller 2. The ink fountain pan 4 is inserted into the ink fountain 3 for that purpose, so that the front wall 5 comes to be located precisely against the peripheral enveloping surface of the ductor roller 2. A support or reinforcement 15, in the form of an arc of an axially symmetrical cylindrical surface extending over the entire length of the ink fountain pan 4. Grooves 16 with seals 17 are located in the reinforcement 15, in the region of the side walls 7 and 8. The seals 17 are inserted in the grooves 16 and they ensure leak-tight closure relative to the rotating ductor roller 2 during operation.

Figure 2:
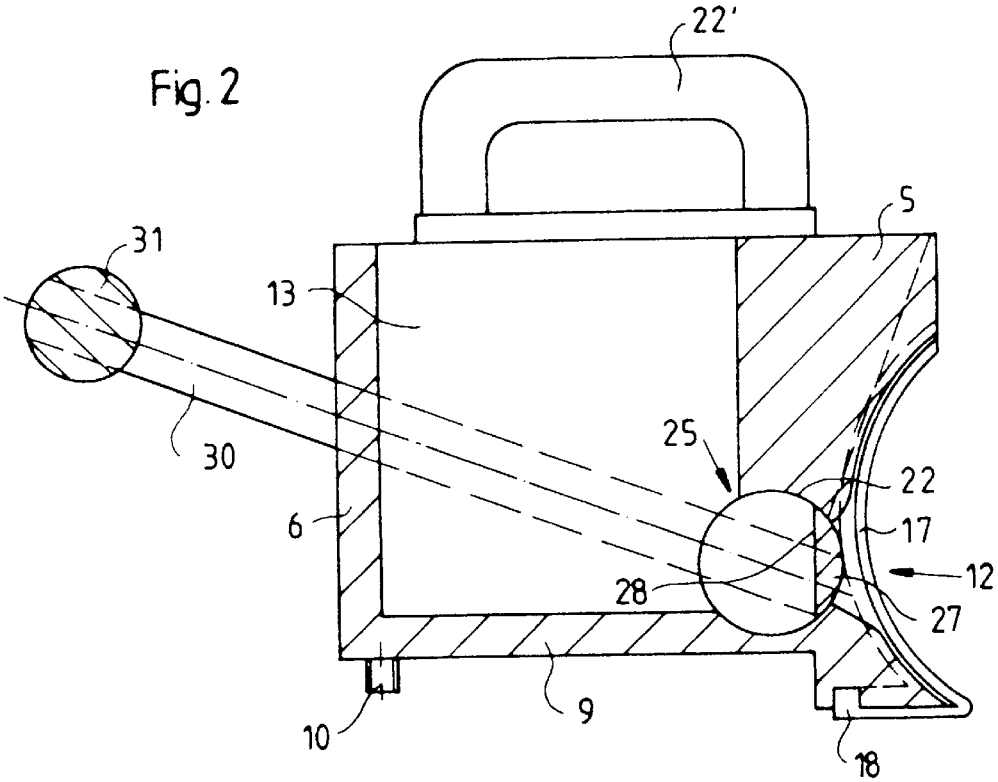
FIG. 2 is a cross-sectional view through a removable ink fountain pan of the inking unit, with a closure member in the closed position.
Figure 3:
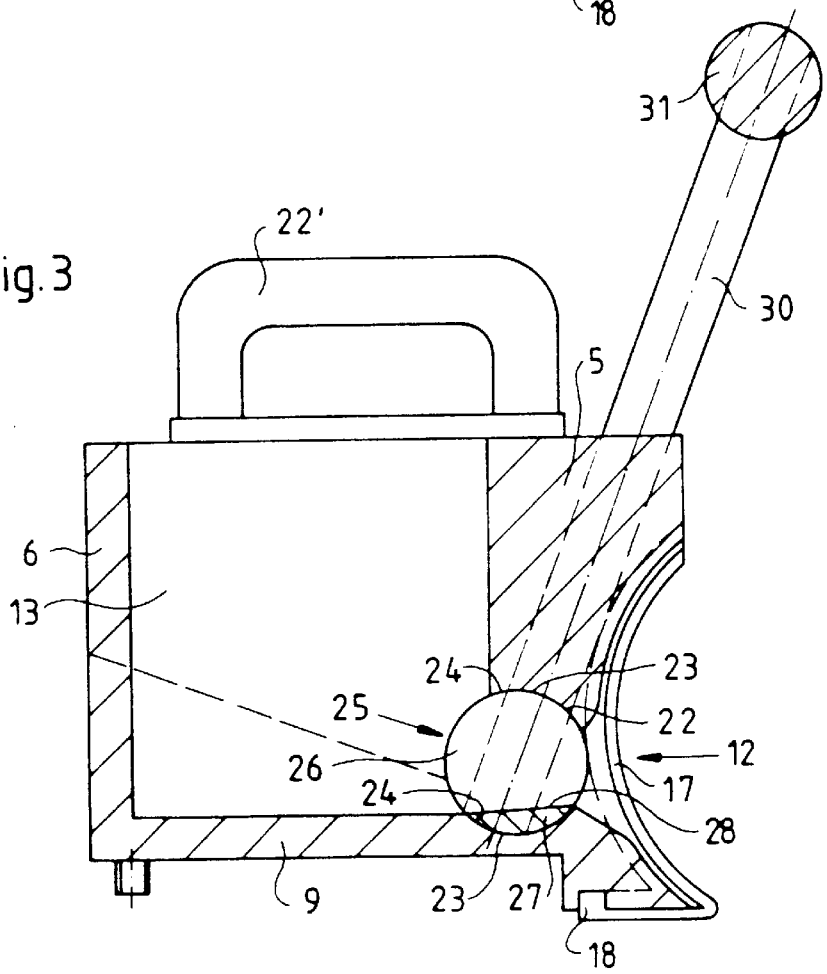
FIG. 3 is a view similar to that of FIG. 2, with the closure member in the open position.
Figure 5:
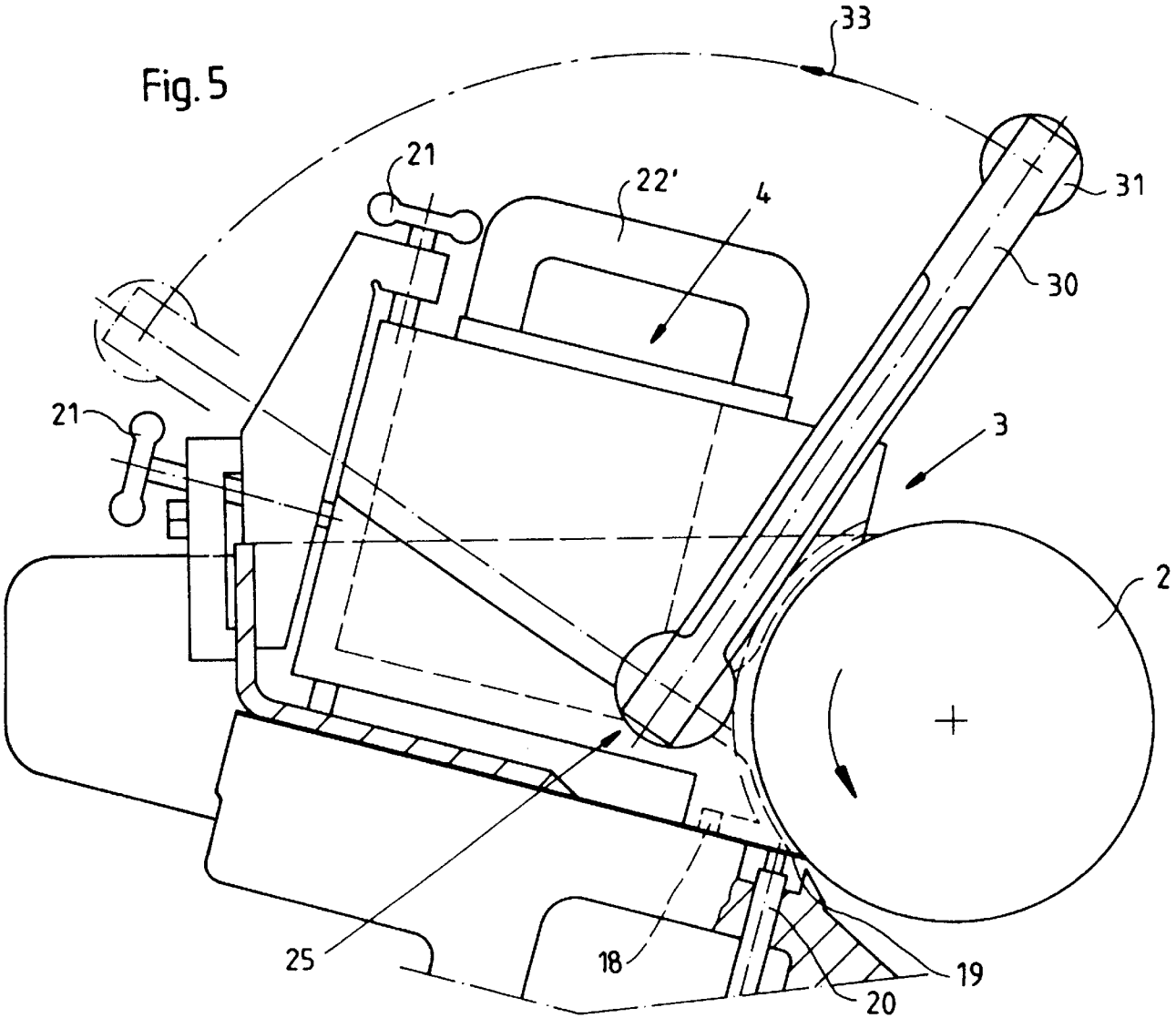
FIG. 5 is a cross-sectional view through the inking unit.

With reference to FIGS. 2 and 3, the seals 17 extend downwards as far as the bottom 9. There is provided a lower sealing region 18 which—when the ink fountain pan 4 is placed in the ink fountain—becomes positioned in the ink fountain 3 against a ductor blade 19 on the ink fountain side (FIG. 5). The ductor blade 19 is essentially a scraper which interacts with the peripheral surface of the ductor roller 2.

The ductor blade 19 is adjusted such that a very thin film of ink is formed on the ductor roller 2 as the same rotates. The pressure of the ductor blade 19 on the ductor roller 2 may be adjusted with setting means 20, for example a set screw.

Tightening means 21 (preferably including threaded spindles) are provided for clamping the ink fountain pan 4 in the ink fountain 3 and towards the ductor roller 2.

Handles 22' are provided at each the upper faces of the side walls 7 and 8 for better handling when the ink fountain pans 4 are to be removed from or placed in the ink fountain 3. The pans 4 are thus easily gripped with two hands.

The front wall 5 is formed with a bearing or support bore 22 which extends over the entire width (transversely to the ink feed direction and parallel to the ductor roller) of the ink fountain pan 4. The bore 22 is located in the region of the duct 12 and it also passes through the sidewalls 7 and 8. Through the sidewalls 7 and 8, the bearing bore 22 is in the shape of a circular cylinder; in the region of the duct 12 formed through the front wall 5, the bearing bore 22 is made of hollow bores 23 in the form of portions of axisymmetric cylindrical surfaces. These surfaces form the walls 24 of the duct 12.

A closure member 25 is pivotally mounted in the bearing bore 22. For this purpose, the closure member 25 includes coaxial, axisymmetric cylinder portions 26 (FIG. 4) which are aligned in the bearing bores 22 formed in the sidewalls 7 and 8. However, with reference to FIG. 4, it is possible to provide, in addition, an axisymmetric cylinder portion 26 inside the duct 12. It should be understood that any number of such coaxial, mutually spaced apart cylinder portions 26 may be disposed inside the duct 12. Duct closure pieces 27 are located between the coaxial cylinder portions 26. The duct closure pieces 27 are essentially formed as portions of a disk, or as a secant section from a cylinder. The pieces 27 are dimensioned such that their flat wall 28, in the form of the secant, causes the duct 12 to be closed in a second pivot position of the closure member 25 (FIG. 2). When the closure member 25 assumes a first pivot position (FIG. 3), the wall 28 is aligned with the inner face of the bottom 9 and, accordingly, the duct 12 is open between the cylinder portions 26.

Two actuating levers 30 extend radially relative to the pivot axis. The levers 30 are mounted at opposite ends 29 (FIG. 1) of the closure member 25. An actuating handle 31, for example in the form of a knob, connects the two levers

30. The handle 31 not only provides for simple handling for the pivoting movement, but it also prevents extraneous torsion on the closure member 25 and it helps assure its structural integrity. Using the actuating handle 31 it is thus possible manually to cause the actuating levers 30 and therefore the closure member 25, to pass from the first into the second or from the second into the first pivot position.

In a preferred embodiment, the sidewalls 7 and 8 are provided with setback regions 32 within which the actuating levers 30 can pivot. It is thus possible to locate several ink fountain pans 4 directly adjacent one another side by side without impeding the pivoting movement of the actuating levers 30. Further, the edges of the setback regions 32 define the maximum pivot angles.

With reference to FIG. 5, if a fountain pan 4 has to be taken out of the ink fountain 3, then the actuating lever 31 is first pivoted in the direction of the arrow 33. This causes the closure member 25 to move from its open position, according to FIG. 3, to its closed position, according to FIG. 2, the latter being represented in broken lines in FIG. 5. In this case, the tightening means 21 are loosened and the ink fountain pan 4 is taken from the ink fountain 3 by means of the handle 22'.

The reverse procedure is followed when a full ink pan 4 is to be placed in the ink fountain 3.

We claim:

1. An inking unit of a rotary printing press, comprising:

an ink fountain carrying a ductor blade, a ductor roller disposed adjacent said ink fountain, and at least one ink fountain pan removably disposed in said ink fountain;

said ink fountain pan having a duct formed therein for conveying printing ink to said ductor roller, said duct being defined by a bearing bore formed across said ink fountain pan;

a closure device operatively associated with said duct, said closure device including a closure member disposed in and rotatably mounted in said bearing bore and pivotally mounted on said ink fountain pan between a first pivot position in which said duct is open and a second pivot position in which said duct is closed; and said closure member including longitudinally spaced apart, mutually coaxial cylinder portions pivotally disposed in said bearing bore.

2. The inking unit according to claim 1, wherein said bore is defined between two arched domes in the form of partial cylindrical surfaces facing one another and extending symmetrically relative to an axis of said bore, said duct being formed by said arched domes.

3. The inking unit according to claim 1, wherein said duct is bounded by walls, and said bearing bore is formed in said walls of said duct.

4. The inking unit according to claim 1, wherein said closure member is formed with two mutually coaxial cylinder portions, and transverse members disposed between said cylinder portions, said transverse members being in the form of portions of a disc for closing said duct.

5. The inking unit according to claim 1, wherein said closure member includes at least one actuating lever for pivoting said closure member, said actuating lever extending radially away from a pivot axis of said closure member.

6. The inking unit according to claim 5, wherein said actuating lever is one of two actuating levers disposed at mutually opposite ends of said closure member.

7. The inking unit according to claim 6, which further comprises an actuating handle disposed between and joining said two actuating levers.

* * * * *